United States Patent [19]

Chen

[11] Patent Number: 4,804,350

[45] Date of Patent: Feb. 14, 1989

[54] POLYGONAL RING-LIKE TOY BUILDING BLOCK HAVING MEANS FOR INTERCONNECTING PLURAL BLOCKS TOGETHER IN DIFFERING ORIENTATIONS, AND ELONGATE STACKING MEMBERS FOR STACKING PLURAL BLOCKS FOR STORAGE

[76] Inventor: Chen-Tsung Chen, No. 15 Alley 2, Fengyuan, Taichung, Taiwan

[21] Appl. No.: 87,363

[22] Filed: Aug. 20, 1987

[51] Int. Cl.[4] ..... A63H 33/06; A63H 33/08

[52] U.S. Cl. ..... 446/127; 446/77; 446/112; 446/115; 446/120

[58] Field of Search ..... 446/77, 108, 112, 113, 446/114, 115, 117, 119, 120, 122, 124, 127; 52/590, 591; 24/115 G; 211/74, 189, 194; 206/503, 504

[56] References Cited

U.S. PATENT DOCUMENTS

| | | | |
|---|---|---|---|
| D. 214,745 | 7/1969 | Walker | 446/127 X |
| 254,606 | 4/1980 | Abelson | 172/333 |
| 1,204,457 | 11/1916 | Kreeft | 24/115 G X |
| 1,257,097 | 2/1918 | Morris | 312/107 |
| 2,472,363 | 6/1949 | Blackinton | 446/127 |
| 2,619,829 | 12/1952 | Tatum | 446/127 X |
| 2,786,301 | 3/1957 | Torricelli | 446/124 |
| 3,310,906 | 3/1967 | Glukes | D 21/108 |
| 3,420,275 | 1/1969 | Glen et al. | 446/124 |
| 3,456,413 | 7/1969 | Fischer | 446/125 X |
| 3,974,898 | 8/1976 | Tullis et al. | 190/3 |
| 4,035,977 | 7/1977 | Fischer | 52/591 X |
| 4,108,562 | 8/1978 | Collard et al. | 446/120 X |
| 4,115,980 | 9/1978 | Martel et al. | 52/591 |
| 4,556,394 | 12/1985 | Chen | 446/114 X |
| 4,583,956 | 4/1986 | Nelson | 446/119 |
| 4,708,684 | 11/1987 | Chen | 446/127 |
| 4,764,143 | 8/1988 | Gat et al. | 446/127 X |

FOREIGN PATENT DOCUMENTS

| | | | |
|---|---|---|---|
| 215727 | 3/1987 | European Pat. Off. . | |
| 1805769 | 8/1970 | Fed. Rep. of Germany | 446/127 |
| 1467702 | 1/1967 | France | 52/590 |
| 14252 | 9/1966 | Netherlands | 206/504 |
| 427207 | 6/1967 | Switzerland . | |
| 1382134 | 1/1975 | United Kingdom | 446/120 |
| 1604260 | 12/1981 | United Kingdom | 211/74 |

*Primary Examiner*—Robert A. Hafer
*Assistant Examiner*—Charles H. Harris
*Attorney, Agent, or Firm*—Holman & Stern

[57] ABSTRACT

A toy building block set suitable for assembling articles of play includes ring like block elements with a circular inner periphery and a polygonal outer periphery with straight side faces. A sixteen-sided polygonal block is provided with square dovetail connector and socket elements arranged on the side faces for connecting the block elements together. Other side faces of the block elements are provided with vertical dovetail chutes for co-operation with elongate stacking members having elongate dovetail projections. The block elements are thus able to be arranged in stacks on the stacking members for storage and transportation. Lashing points are provided on the stacking member ends for accepting a lashing means to secure the stack positively, and several stacks of block elements can be lashed together for packaging large sets of blocks. Different embodiments are presented. In one embodiment the block elements are provided with snap-fit socket elements.

11 Claims, 7 Drawing Sheets

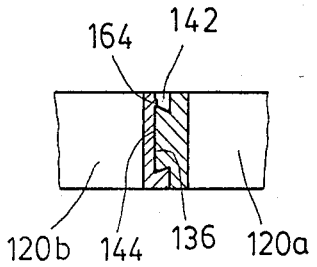
FIG. 12
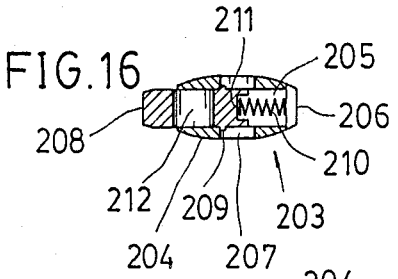
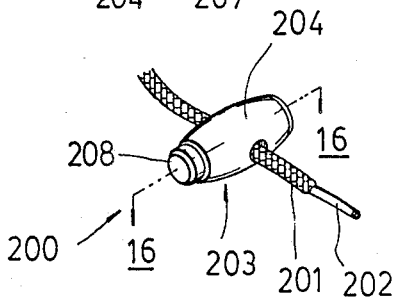
FIG. 15
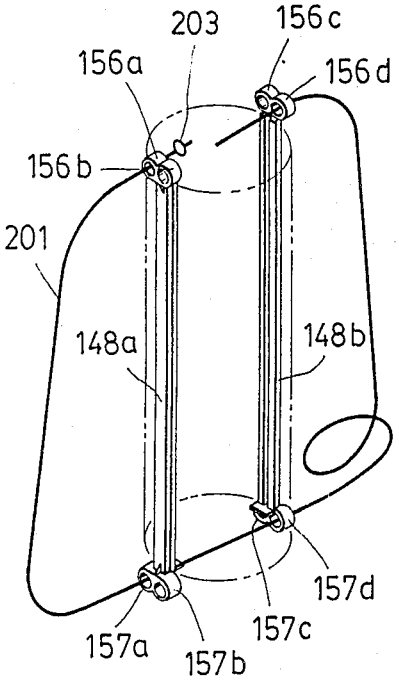
FIG. 13
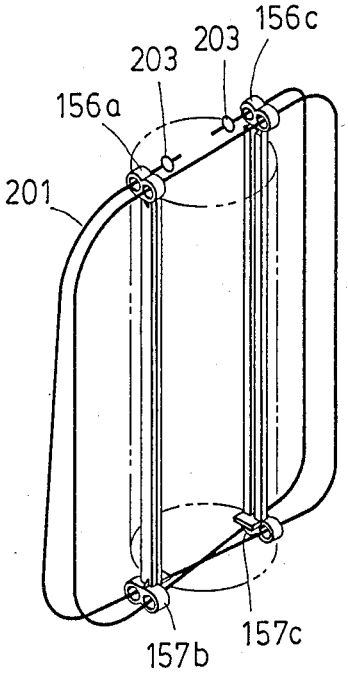
FIG. 14

POLYGONAL RING-LIKE TOY BUILDING BLOCK HAVING MEANS FOR INTERCONNECTING PLURAL BLOCKS TOGETHER IN DIFFERING ORIENTATIONS, AND ELONGATE STACKING MEMBERS FOR STACKING PLURAL BLOCKS FOR STORAGE

CROSS-REFERENCE TO RELATED APPLICATIONS

The present invention is related to the inventions set forth in my copending U.S. patent application Ser. No. 895,963 filed Aug. 12, 1986, now U.S. Pat. No. 4,708,604 and also in my copending U.S. design patent application Ser. No. 07/076,198 filed July 22, 1987.

BACKGROUND AND SUMMARY OF THE INVENTION

This invention relates to toy building block sets of the type wherein a plurality of block-like elements can be selectively connected together with one another in differing orientations in order to assemble articles of play of various shapes and sizes.

In U.S. Pat. No. 4,556,394 there is disclosed a set of toy building blocks in which each block has an outer perimeter frame having straight sides, each block being generally rectangular in shape. Connecting elements and sockets are provided along the frame periphery, so that the blocks are capable of being selectively connected together at selective relative positions to form various shaped articles. The blocks are further formed with inner circular ring-like frame portions joined integrally with the outer peripheral frame, for accommodating cylindrical flotation members therethrough, to enable the assembling of floating toys. Additionally, there are provided blocks having triangular frames with peripheral connecting elements and sockets, so that the toy block set of this patent disclosure is complicated in makeup due to its being comprised of different types and shapes of blocks. Also, the arrangement of the connector elements and sockets on the blocks varies, some blocks having connector elements and sockets on adjacent sides, and other blocks having the connector elements and sockets on opposite sides. Thus, the toy block set of this patent disclosure is complicated to assemble. Still further, because the blocks of this patent disclosure have straight outer frames for accommodating the connecting elements and sockets, and circular inner frame portions for accommodating flotation members, the blocks are relatively heavy, requiring considerable material, and expensive to manufacture.

In my copending U.S. patent application Ser. No. 895,863 there is disclosed a toy building block set in which the blocks are formed as circular members. Several different types of such blocks are disclosed, each having different numbers and arrangements of connecting elements and sockets formed integrally thereon around the outer periphery of the circular block members, so that the blocks of the copending patent application are capable of being selectively connected at selected relative positions to assemble articles of play. The circular block members are also able to accommodate tube-like cylindrical flotation members therethough for assembling floating articles. Because the block members disclosed in the copending patent application are simpler in construction, less material is required, offering a reduction in weight and cost of manufacture.

However, as the toy building block set disclosed in copending application Ser. No. 895,863 includes various different block elements, there is still the problem that assembly of articles with the blocks is complicated, and cost of manufacture is high.

In order to obviate the above mentioned disadvantages, the toy building block set of the present invention includes ring-like block elements each having a geometrical polygonal outer peripheral wall of, for example, sixteen sides, and a circular inner wall. Advantageously, the block elements of the present invention are alike, thus realizing an economy of manufacture. Further, because the block elements of the present invention are alike, the toy building block set of the present invention is simple to use and articles of play can be easily assembled in various shapes.

The block elements of the present invention are provided with connection means formed integrally along their outer peripheral walls. More particularly, the connection means include dovetail projections and sockets spaced around the outer periphery of the block elements for enabling the block elements to be selectively connected together at selected relative positions and orientations.

With regard to the use of dovetail connection means, Swiss patent publication No. 427,207 discloses various ring-like block elements having dovetail projections extending outwardly along the outer peripheral walls thereof. For connecting the block elements of the Swiss disclosure together, there are also provided smaller H-shaped coupling blocks having a pair of dovetail sockets extending inwardly along opposite sides thereof, for receiving a dovetail projection of one block element in each dovetail socket. In this way, two blocks can be connected through the intermediary of a coupling block. However, because the dovetail projections and sockets of the Swiss disclosure are elongate and extend from the top to the bottom of the block and coupling elements, there is the limitation present that the blocks can be connected in only one relative orientation, that is, connected only in a horizontal position. Thus, it is not possible to connect the blocks of the Swiss disclosure in an intersecting orientation, and the shapes of articles which can be assembled is therefore limited.

U.S. Pat. No. 3,456,413 discloses elongate tubular structural elements some of which are provided with elongated undercut grooves and some of which are provided with elongated undercut grooves as well as elongated projecting coupling heads having narrowed neck portions. In this way the projecting coupling heads are receivable in the undercut grooves for connecting elements together. Further, end caps are provided for closing off open ends of the tubular structural elements, and these end caps may also be provided with undercut elongate grooves or with projecting coupling heads having undercut narrowed neck portions. However, because the projecting coupling heads of the elongate tubular structural elements are elongated along the axis of the tubular structural elements, it is not possible to couple the tubular structural elements in an intersecting orientation, and the structural elements of this prior patent disclosure suffer from a similar limitation as that of the Swiss publication discussed above.

The toy building block set of the present invention overcomes the above-described limitations by providing block elements having integral dovetail or undercut projecting connector and socket connection means which advantageously permit connecting the block elements in both a horizontal relative orientation as well as in an intersecting relative orientation.

The present invention further provides means for effectively stacking and packing the toy building block set thereof for ease of storage and transportation. The packaging means of the present invention includes a pair of dovetail grooves formed in the outer peripheral wall of each of the block elements, and elongated stacking members having an elongated dovetail projection extending therealong, so that a plurality of block elements may be slid onto the stacking members to form an orderly stack of blocks aligned one atop another. Each stacking member may advantageously be provided at its ends with lashing points for receiving lashing means, whereby one or more stacks of block elements may be securely lashed into a pack of blocks, thus providing a simple yet effective means for packaging the block set.

It is therefore an object of the present invention to provide a toy building block set which effectively overcomes the above-described limitations and which is simple in structure and easy to use.

It is a further object of the present invention to provide packaging means for a toy building block set for ease of storage and transportation thereof.

These as well as other objects, features and advantages of the present invention will be more fully appreciated from the following detailed description and claims taken together with the drawings, in which like reference numerals designate like elements among the various figures.

BRIEF DESCRIPTION OF THE DRAWINGS

FIG. 12 is a partial sectional view showing two block means of the second embodiment connected in a horizontal orientation.

FIGS. 13 and 14 are successive perspective views showing the packaging means of the present invention in use with a single stack of blocks.

FIG. 15 is a perspective view of a lashing means of the present invention.

FIG. 16 is a sectional view taken along line 16—16 in FIG. 15 showing an adjustable toggle button of the lashing means of the invention.

DETAILED DESCRIPTION OF THE INVENTION

Referring now to FIGS. 1 through 9 there is shown a block of a first embodiment of the present invention designated generally at 20. Block 20 is ring-like in form, having the general shape of a short hollow cylinder with a circular inner peripheral wall 22. In this way, block 20 is able to accommodate a tube-like cylindrical flotation device (not shown) inserted therethrough for constructing floating articles.

Figure 6:
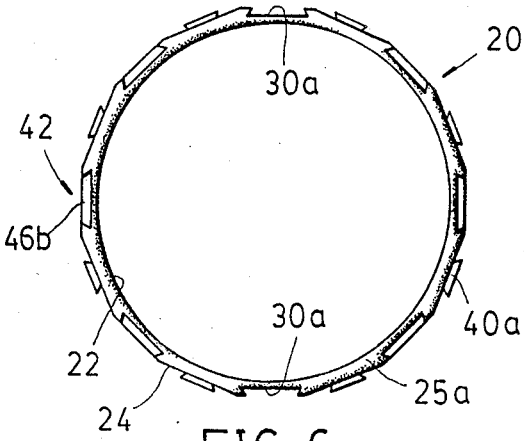
Figure 7:
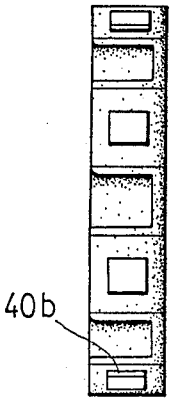
Figure 8:
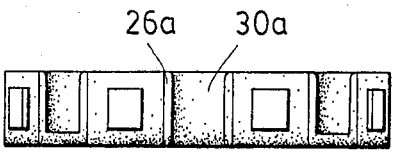
Figure 9:
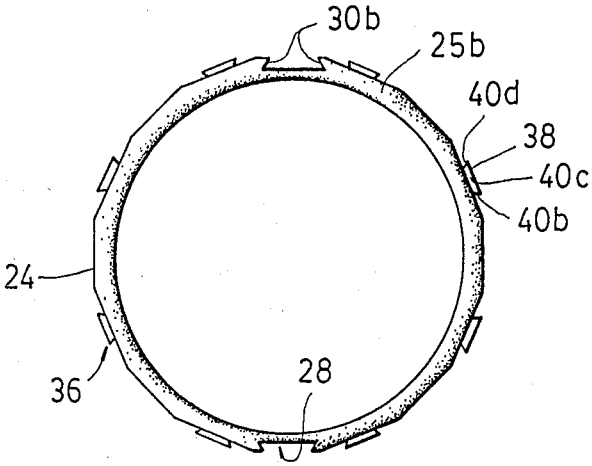

Block 20 is also provided with a polygonal outer peripheral wall 24, so as to define, for example, a sixteen-sided regular polygon when viewed from above or below, as more clearly shown in FIGS. 6 and 9, with each of the side faces thereof being straight and of equal size and having all angles therebetween equal. In this way, respective side faces of two blocks may be brought into mutually abutting relation with each other.

As may be seen from FIGS. 1–9, two diametrally opposite side faces **26*a*, 26*b* of outer wall 24 of block 20 each have a vertical dovetail chute 28 formed therein passing entirely from the top surface 25*a* to the bottom surface 25*b* thereof. Chutes 28 are each defined by an inner wall 30*a* and a pair of mutually outwardly converging side walls 30*b* extending between inner walls 30*a* and side faces 26*a*, 26*b* to form dovetail configurations. The purpose of chutes 28** will be described later.

Block 20 is provided therearound with a plurality of connector elements 32 and socket elements 34 formed integrally on outer wall 24 on other side facess thereof, as will now be described. As shown in FIGS. 2 through 9, the connector elements 32 are each comprised of a dovetail projection 36 having a vertical square front face 38 extending outwardly from and joined to the outer peripheral wall 24 of block 20 by side walls **40*a*, 40*b*, 40*c* and 40*d* at the top, right, bottom and left sides, respectively. Side walls 40*a*–40*d* mutually converge from front face 38 towards outer peripheral wall 24 to give projection 36** its dovetail configuration.

Socket elements 34 are each comprised of a square dovetail socket 42 formed in outer peripheral wall 24 and top surface **25*a*, and extending downwardly from top surface 25*a* of block 20, but not extending through bottom surface 25*b* thereof. Each socket 42 thus has a closed bottom and is defined by a vertical back face 44 extending downwardly from top surface 25*a* and joined to outer peripheral wall 24 of block 20 by a right side wall 46*a*, bottom side wall 46*b* and left side wall 46*c*. Side walls 46*a*–46*c* - mutually converge from outer peripheral wall 24 towards back face 44 to give socket 42** its dovetail configuration.

Connector elements 32 and socket elements 34 are formed with complementary dovetail configurations so that the dovetail projection 36 of connector elements 32 can be inserted into the dovetail socket 42 from the top and slid downwardly thereinto to fully seat projection 36 in socket 42. To this end, back face 44 of socket 42 should be only slightly wider than front face 38 of projection 36, and socket 42 should extend only slightly larger than projection 36. In this way, projections 36 can be fully accommodated within sockets 42 while at the same time the respective side faces of connected blocks can be brought into abutting relation with one another at the point of connection. This abuttment serves to aid connection of the blocks and also absorbs loads imparted to the connection point. Similarly, the mutual angle of convergence of side walls **46*a*–46*c*** of socket 42 should be equal to the mutual angle of convergence of side walls 40*a*–40*d* of projection 36. As a rule of thumb therefore, sockets 42 should be sized only slightly larger than projections 36 so that a snug fit can be achieved therebetween permitting easy connection and disconnection of the blocks 20 with one another.

Figure 1:
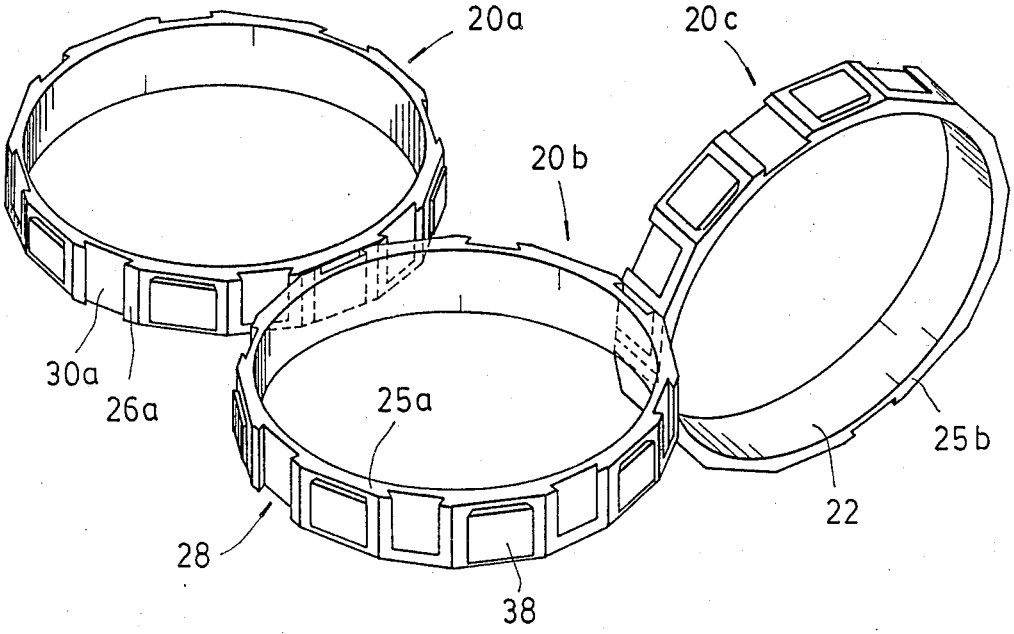
FIG. 1 is a perspective view showing three connected block means of a first embodiment of the invention, illustrating relative horizontal and intersecting or vertical connection of the blocks.
Figure 2:
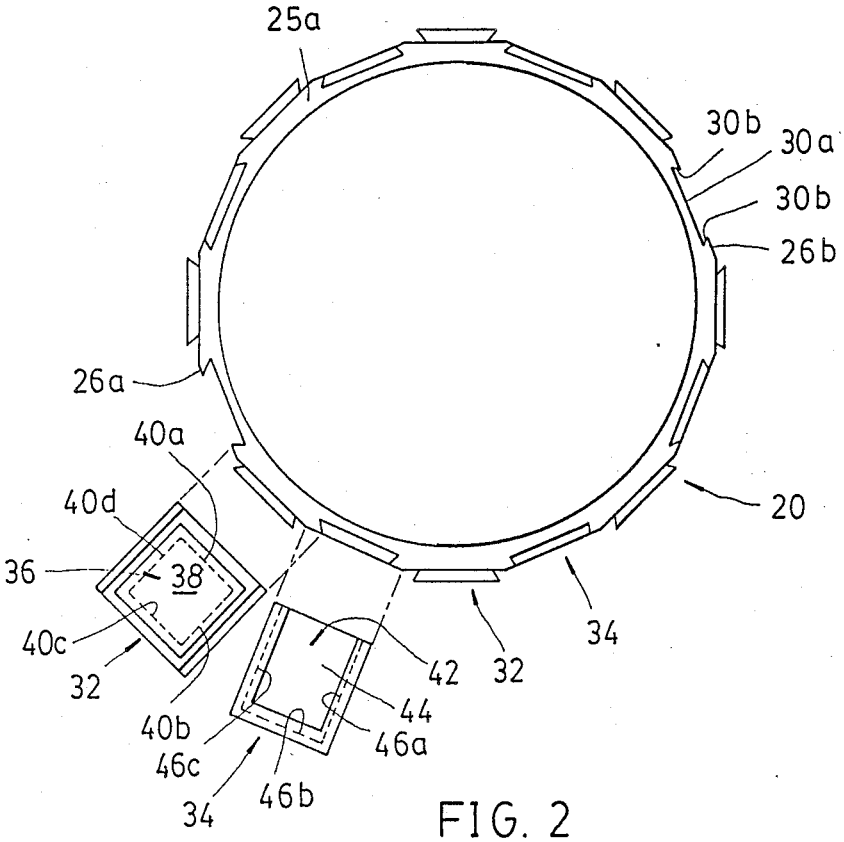
FIG. 2 is a top view of the block means of the first embodiment, showing partial rotated views of the connector and socket means thereof.
Figure 3:
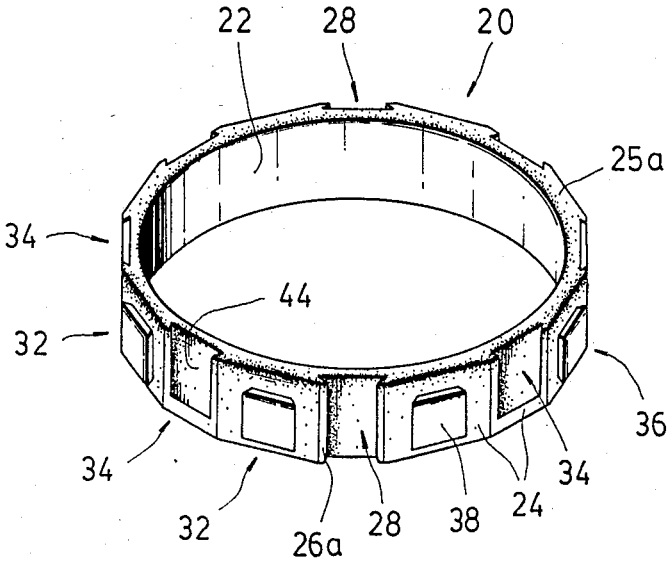
FIG. 3 is a perspective view of the block means of the first embodiment.
Figure 4:
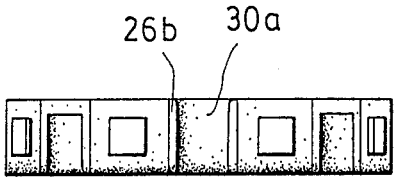
FIGS. 4 through 9 are respective back, left side, top, right side, front, and bottom views showing the block means of the first embodiment.
Figure 5:
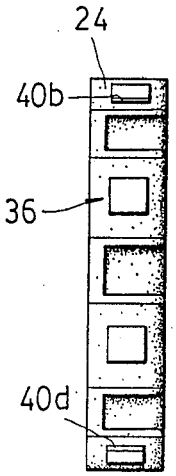

In order to provide variety in the types and shapes of articles which can be assembled with the block set of the present invention, the connector elements 32 and socket elements 34 are formed with square dovetail configurations as described above. In this way, the blocks 20 can be connected together in various relative orientations. For example, as shown in FIG. 1, two blocks 20*a* and 20*b* can be connected together in a horizontal relative orientation. Alternatively, two blocks 20*b* and 20*c* can be assembled in an intersecting or vertical relative orientation. Thus, as will be readily appreciated, the square configuration of the dovetail projections 36 and sockets 42 permits the blocks to be connected in four possible relative orientations at each point of connection therebetween.

Further, to provide variety in the types and shapes of articles which can be assembled with the block set of the present invention, plural connector elements 32 and socket elements 34 are arranged around the periphery of blocks 20. For example, in a block 20 having a sixteen-sided outer peripheral wall, with two diametrally opposite side faces 26*a*, 26*b* being provided with chutes 28, then fourteen side faces are available for connector elements 32 and socket elements 34. In the sixteen-sided block 20 illustrated, eight side faces are provided with connector elements 32 formed integrally thereon and six side faces are provided with socket elements 34 formed integrally therein, while two diametrally opposite side faces 26*a*, 26*b* are provided with chutes 28 formed integrally therein. Typically, the connector elements 32 and socket elements 34 may be positioned so as to occupy alternating side faces around the block periphery with each socket element 34 positioned between two connector elements 32 as shown.

Figure 10:
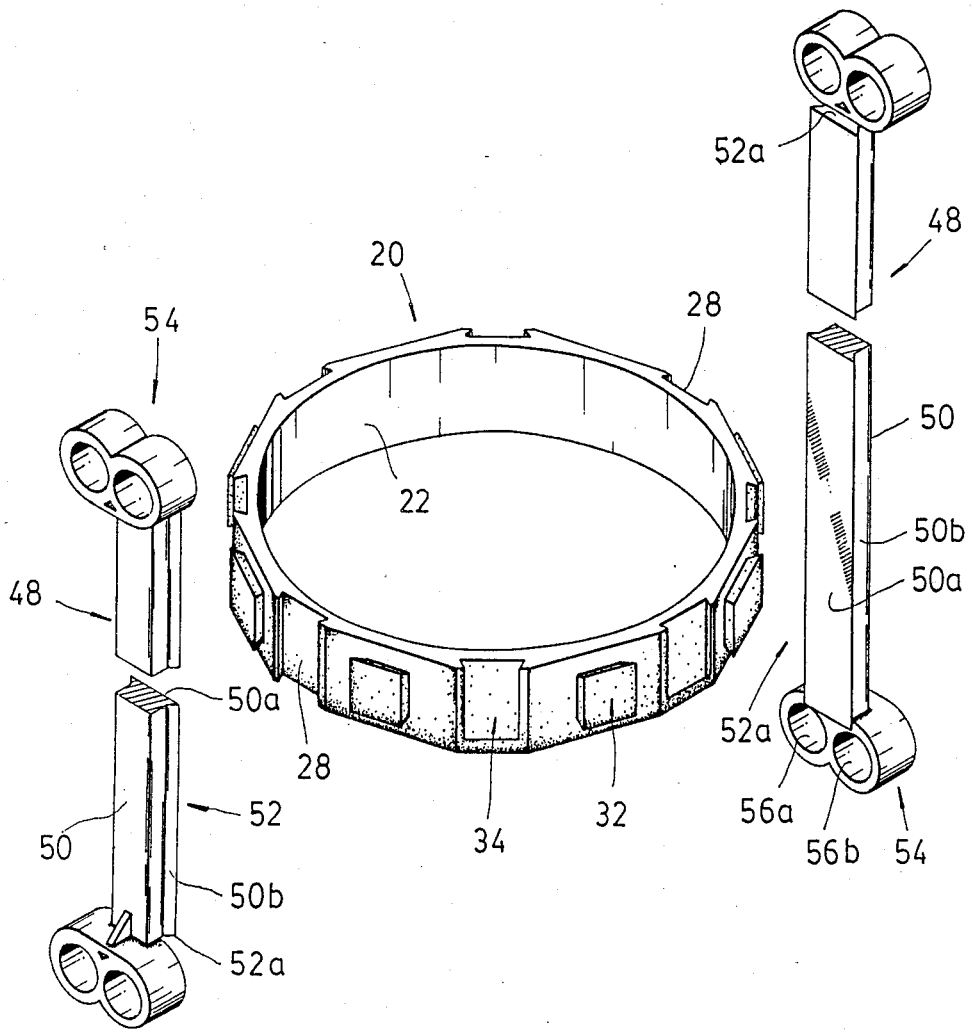
FIG. 10 is a perspective view showing a block means of the first embodiment together with two stacking means of a first embodiment of the invention.

Having now described the structure of the block means of the first embodiment, the packaging means of the first embodiment will now be described. Referring to FIG. 10, there is shown a block 20 provided with two chutes 28 formed in diametrally opposite side faces 26*a*, 26*b* thereof, as described above. In order to permit a plurality of blocks to be easily arranged into a secure vertical stack for storage of the block set, there are provided a pair of elongate stacking members designated at 48. Each stacking member 48 is comprised of an elongate stacking bar 50 having formed along the length of a front face 50*a* thereof a longitudinal projection 52 having mutually converging side walls 50*b* extending between front face 50*a* - and stacking bar 50 and giving projection 52 a dovetail configuration complementary to that of the vertical chutes 28 of block 20. Projection 52 is formed so as to extend along the length of stacking bar 50 and has open ends 52*a* corresponding with the ends of stacking bar 50.

In this way, block 20 can be inserted onto stacking member 48, or alternately stacking member 48 can be inserted into chute 28 in block 20, by positioning chute 28 in block 20 over an end 52*a* of longitudinal projection 52 of stacking bar 50, engaging projection 52 in chute 28, and then sliding blocks 20 along projection 52 to securely engage block 20 on stacking member 48. By performing the same operation a number of times as required, a vertical stack of blocks can be mounted on the stacking member 48.

In order to permit the securing of a stack of blocks thusly mounted on the stacking member 48, each stacking member 48 is provided at each of its ends with lashing points 54 comprising a pair of integral lashing rings 56*a*, 56*b* Lashing rings 56*a*, 56*b* are provided in order to accommodate a lashing means, described later, being passed therethrough in order to securely bind the top and bottom of a stack of blocks mounted on the stacking members 48, as will be described in detail below with reference to a second embodiment of the invention.

Figure 11:
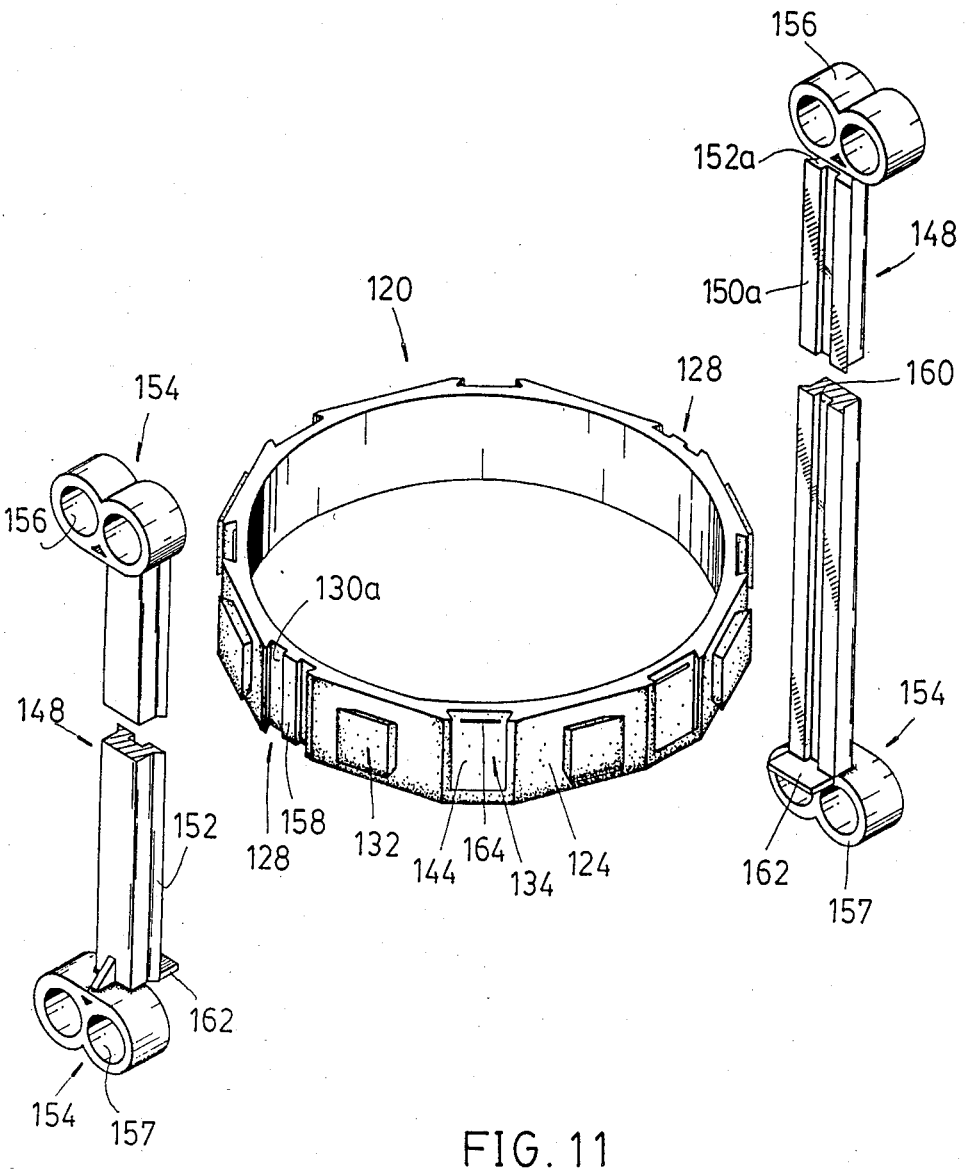
FIG. 11 is a perspective view showing a block means and two stacking means of a second embodiment of the invention.

Referring now to FIG. 11, a block 120 and a pair of stacking members 148 of a second embodiment of the present invention are shown. Blocks 120 and stacking members 148 are generally similar in structure to blocks 20 and stacking members 48 of the first embodiment, and therefore only those points of difference existing between the embodiments will be described in detail.

With regard to blocks 120, there are provided integrally formed in the outer peripheral wall 124 thereof at diametrally opposite side faces thereof a pair of vertically extending dovetail chutes 128 in similar fashion to chutes 28 of the first embodiment, but with each of chutes 128 having centrally formed on the inner wall 130*a* thereof a vertically extending rib 158 protruding outwardly therefrom. Similarly, each elongate stacking member 148 has a longitudinally extending groove 160 formed centrally in the front face 150*a* of the dovetail longitudinal projection 152 thereof. Ribs 158 and grooves 160 have complementary configurations, as do chutes 128 and projections 152, so that stacking of the blocks 120 on stacking members 148 is performed by an operation similar to that described above with respect to the first embodiment. Provision of ribs 158 serves the purposes of strengthening the block wall in the area of chutes 128 as well as preventing the connector elements 132 from being inserted into chutes 128.

Further, each stacking member 148 is formed with an integral support plate. 162 formed extending outwardly from and blocking off one end of dovetail longitudinal projection 152, while the other end 152*a* of projection 152 is open for inserting blocks 120 thereonto at chutes 128 thereof. In this way, when the blocks 120 are stacked upon stacking members 148, the stack will be supported at the bottom by support plates 162.

The connector elements 132 of the second embodiment are identical in configuration to the connector elements 32 of the first embodiment. Likewise, the socket elements 134 of the second embodiment differ only slightly in configuration from socket elements 34 of the first embodiment, by the provision on the back face 144 of each socket 142 of a transversely extending retainer 164 protruding outwardly therefrom as shown in FIGS. 11 and 12. Retainer 164 is formed to protrude only slightly outwardly from back face 144 of socket 142 so as to still permit insertion of dovetail projection 136 of connector element 132 past retainer 164 into socket 142, that is, to ensure ease of connection while also ensuring a secure connection.

To this end, socket 142 is configured with sufficient clearance to ensure ease of insertion of projection 136 past retainer 164, that is, so that connector element 132 is able to be snapped into and out of tight engagement within socket element 134. Retainer 164 is thus located at a proper height from the socket bottom so as to ensure that projection 136 is tightly retained in socket 142 when the connector element 132 and socket element 134 of blocks 120 are connected to assemble articles.

Referring now to FIGS. 13 through 19, there is shown at 200 the lashing means of the present invention. Lashing means 200 is comprised of a length of lashing cord 201 the ends of which may be provided with end caps 202 for ease of handling and to prevent fraying or unraveling, in the case that a braided cord is used. Inwardly from end caps 202, lashing cord 200 may be provided at each end with a pair of adjustable toggle buttons 203.

As shown in FIG. 16, each toggle button 203 consists of an outer barrel 204 having an axial bore 205 closed at one end 206. Barrel 204 also has formed therethrough a cross bore 207 intersecting axial bore 205. A plunger 208 is slidable in axial bore 205, plunger 208 being provided with a shoulder 209 to retain plunger 208 within axial bore 205. A spring 210 is provided in axial bore 205 between end 206 of barrel 204 and the inner end 211 of plunger 208 to bias plunger 208 away from end 206. Plunger 208 is also provided with a cross bore 212, and by depressing plunger 208 the cross bore 212 can be aligned with the cross bore 207 in the outer barrel 204.

Cross bores 207 and 212 are sized to permit passage therethrough of lashing cord 201. In this way, by depressing plunger 208 to align cross bores 207 and 212, then lashing cord 201 can be inserted therethrough, and by releasing plunger 208 the lashing cord 201 will be securely retained in toggle button 203 by plunger 208 due to the urging action of spring 210 acting upon plunger 208. Shoulder 209 of plunger 208 extends into cross bore 207 of barrel 204 so as to register cross bore 212 in plunger 208 with cross bore 207, and to provide a stop when plunger 208 is depressed. Thus, by depressing plunger 208, toggle button 203 can thus be easily moved to a desired position along lashing cord 201, and by then releasing plunger 208 toggle button 203 will be retained in the desired position on lashing cord 201.

Referring again to FIG. 11, the stacking members 148 are provided at each end thereof with integral lashing points 154 each formed as a pair of integral lashing rings 156, 157. Lashing rings 156, 157 are sized to permit toggle buttons 203 to pass therethrough in an end-wise fashion, however, lashing rings 156, 157 are small enough to prevent passage therethrough of toggle buttons 203 in a cross-wise fashion.

FIGS. 13 and 14 illustrate the packaging means of the present invention being used for packaging a single stack of the block means of the present invention. Having stacked a vertical stack of blocks 120 on a pair of stacking members **148*a*, 148*b*, then, as shown in FIG. 13, one end of lashing cord 201 is passed through the leftmost top lashing ring 156*a* of the left stacking member 148*a*, downwardly along left stacking member 148*a*, through the leftmost bottom lashing ring 157*a* of left stacking member 148*a*, passed once across the stack bottom, then through the right bottom lashing ring 157*d* of right stacking member 148*b*, upwardly along right stacking member 148*b* and through right top lashing ring 156*d* of right stacking member 148*b***.

As shown in FIG. 14, the lashing operation is continued by passing the lashing cord 201 through right top lashing ring **156*b* of left stacking member 148*a*, down along left stacking member 148*a* again and through right bottom lashing ring 157*b* thereof, again across the stack bottom to criss-cross the first pass, then through left bottom lashing ring 157*c* of right stacking member 148*b* and upwardly therealong, and then finally through left top lashing ring 156*c* of right stacking member 148*b*. To secure the stack, the toggle buttons 203 at each end of lashing cord 201 can then be adjusted along the cord inwardly from the cord ends to cinch the toggle buttons up against the lashing rings 156*a*, 156*b* in cross-wise fashion to prevent the toggle buttons 203 from passing through the lashing rings 156*a*, 156*c***.

Figure 17:
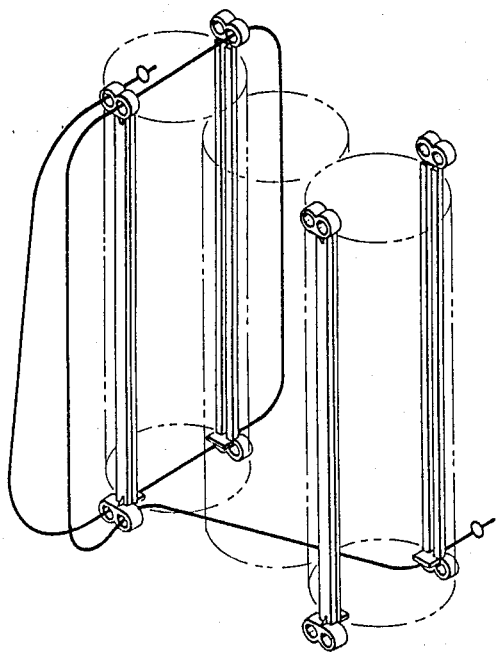
FIGS. 17 through 19 are successive perspective views showing the packaging means of the present invention in use with three stacks of blocks.
Figure 18:
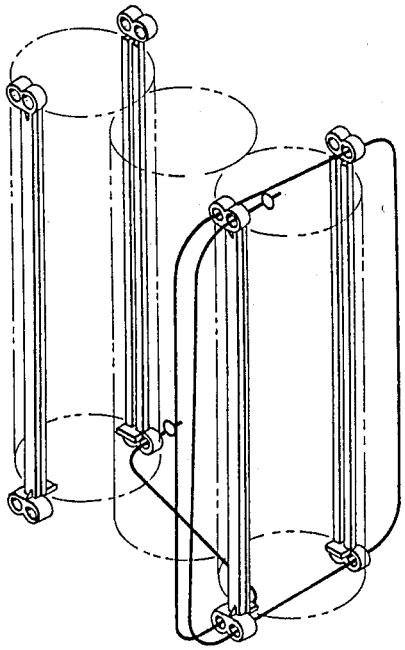
Figure 19:
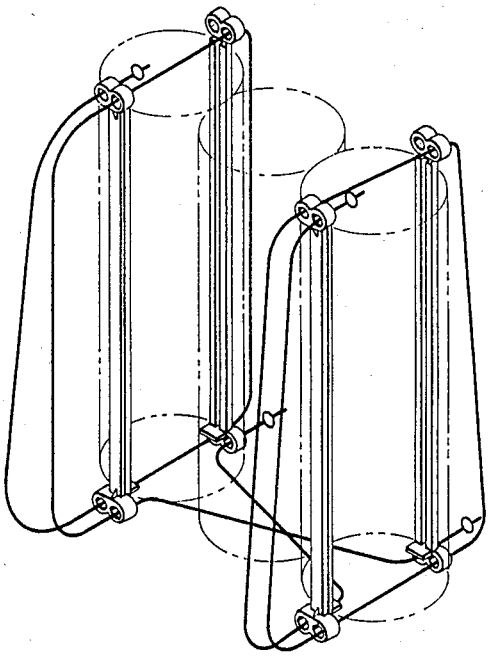

FIGS. 17 through 19 illustrate the successive steps for packaging a set of blocks arranged in three stacks. In this case, three stacks of blocks could be first arranged by connecting three blocks at a time in horizontal relation with one another to form a horizontal row of three blocks in line side by side, and with the chutes of the end blocks oriented properly for stacking on the stacking members, and then mounting the three connected blocks at a time upon respective stacking members at the end blocks, then repeating the operation until three stacks of connected blocks are arranged. This could also be accomplished by one block of each end stack on a respective pair of stacking members at a time, and then connecting the two end blocks to a center block. Alternately, two stacks of blocks could be mounted on respective pairs of stacking members, and then a center stack of blocks connected to each end stack.

In any case, the lashing operation as shown is similar to that for a single stack, except that after having first lashed each end stack, the bottom lashing points of the respective stacking members of the end stacks are lashed together by passing the lashing cord for each end stack from a respective inside lashing ring across the bottom of the center stack to the inside bottom lashing ring of the corresponding opposite corner stacking member, so that the respective lashing cords pass in criss-cross fashion across the bottom of the center stack between the bottom lashing rings of the respective end stack stacking members. Further ways of lashing the three stacks for storage are of course possible, for example the center stack could also be supported on a center pair of stacking members and the lashing rings of this center pair of stacking members lashed together with those of the end stack stacking members. FIGS. 17–19 show how three stacks of blocks can be lashed for packaging using only two pairs of stacking members, and a pair of lashing cords, but the packaging means of the present invention makes it possible to package any number of blocks in any number of stacks by provision of an adequate number of stacking members and lashing means. It is also contemplated that stacks of blocks could be lashed together to assemble articles of play.

The block means and stacking members of the present invention can be molded from durable plastic. It should be noted that while for purposes of description and illustration a block having sixteen sides is shown, the present invention is applicable to blocks having outer peripheral side walls with various polygonal shapes, although polygons with an even number of side faces are most practical.

The lashing cord and toggle buttons of the lashing means should be of durable material as well, for withstanding the rigors of play and transportation of the block set It will be appreciated from the above description that the block set and packaging means re amenable to various modifications within the scope of the present invention, which is limited only by the appended claims.

What is claimed:

1. A toy building block comprising:

a short hollow cylindrical ring-like block element having a circular inner peripheral wall, an outer peripheral wall having a regular polygonal perimeter, and top and bottom surface joining said inner and outer peripheral walls, said outer peripheral wall having a plurality of straight side faces;

a plurality of connector elements each singularly provided on one of plural first selected side faces of said outer peripheral wall, each of said connector elements including a vertical square dovetail projection having a square front face projected radially outwardly from and joined to said one side face by side walls on top, right, bottom and left sides of said front face, said side wall all mutually converging radially inwardly from said front face to said first side face; and a plurality of socket elements each singularly provided in one of plural second selected side faces of said outer peripheral wall, each of said socket elements including a square dovetail socket recessed into said one side face and opening upwardly through said top surface and radially inwardly through said one side face, said socket having a square vertical back face recessed from said one side face, said back face being bounded on its right, bottom and left sides by side wall which all mutually converge radially outwardly from said back face to said second side face, the size and configuration of each said connector element and socket element being complementary for permitting said connector elements to be inserted and accommodated snugly in said socket elements for connecting like ones of said building blocks together in horizontal as well as intersecting relative orientation with each other and with the respective sides faces thereof in abutting relation at points of connection therebetween, each said socket element being provided with a transverse protruding retainer means provided on said back face to each said socket element for providing a snap fit with connector elements of like blocks inserted in said socket elements, and a pair of vertical dovetail chutes each formed in one of a pair of third side faces of said outer peripheral wall, each said chute having a recessed vertical inner wall extending between said top and bottom surfaces of said block element, and having side walls mutually diverging radially outwardly from said recessed vertical inner wall to said third side face, and further having a vertically extending rib formed centrally on said vertical inner wall and protruding radially outwardly therefrom, and wherein said outer peripheral wall has sixteen side faces, said third side faces being diametrally opposite one another and bounded on each side by one of said first side faces, each of said second side faces being bounded on each side by one of said first side faces.

2. A toy building block set comprising:

a plurality blocks each comprised of:

a short hollow cylindrical ring-like block element having a circular inner peripheral wall, an outer peripheral wall having a regular polygonal perimeter, top and bottom surfaces joining said inner and outer peripheral walls, said outer peripheral wall having a plurality of straight side faces;

a plurality of connector elements each singularly provided on one of plural first selected side faces of said outer peripheral wall, each of said connector elements including a vertical square dovetail projection having a square front face projected outwardly from and joined to said one side face by side walls on top, right, bottom and left sides of said front face, said side walls all mutually converging inwardly from said front face to said first side face;

a plurality of socket elements each singularly provided in one of plural second selected side faces of said outer peripheral wall, each of said socket elements including a square dovetail socket recessed into said one side face and opening upwardly through said top surface and inwardly through said one side face, said socket having a square vertical back face recessed from said one side face, said back face being bounded on its right, bottom and left sides by side walls which all mutually converge radially outwardly from said back face to said second side face, the size and configuration of each said connector element and socket element being complementary for permitting said connector elements to be inserted and accommodated snugly in said socket elements for connecting like ones of said building blocks together in horizontal as well as intersecting relative orientation with each other and with the respective side faces thereof in abutting relation at points of connection therebetween; and a pair of vertical dovetail chutes each formed in one of a pair of third side faces of said outer peripheral wall, each said chute having a recessed vertical inner wall extending between said top and bottom surfaces, each said chute also having side walls mutually converging radially outwardly from said inner wall to said third side face; and means for stacking a plurality of said block elements comprised of a pair of elongate stacking members each provided with a longitudinal dovetail projection extending therealong having a complementary configuration to that of said vertical chutes of said block elements whereby said longitudinal dovetail projection of each said stacking member may be slidably engaged in a corresponding vertical dovetail chute of said block elements, said longitudinal dovetail projection of said stacking member having open ends for the insertion thereof into said vertical chutes of said block elements.

3. A toy building block set according to claim 2, wherein each said stacking member is provided at each of its ends with a pair of lashing rings formed integrally therewith.

4. A toy building block set according to claim 3, wherein said outer peripheral wall of each of said blocks has sixteen side faces, said third side faces being diametrally opposite one another and bounded on each side by one of said first side faces, each of said second side faces being bounded on each side by one of said first side faces.

5. A toy building block set according to claim 3, further comprising lashing means for securing a stack of blocks arranged upon a pair of said stacking members, said lashing means being adapted for being selectively passed through said lashing rings of the ends of said stacking members.

6. A toy building block set according to claim 5, wherein said lashing means comprises a lashing cord means and adjustable toggle button means being selectively movable and immovable along said lashing cord means, said toggle button means being insertable in end-wise fashion through said lashing rings of said stacking members, but not being insertable in cross-wise fashion through said lashing rings.

7. A toy building block set according to claim 2, wherein each said socket element is provided with a transverse protruding retainer means provided on said back face of each said socket element for providing a snap fit with connector elements of like blocks inserted in said socket elements;

each said vertical chute is provided with a vertically extending rib formed centrally on said inner wall thereof and protruding outwardly therefrom; and each said stacking member is provided at one end of the dovetail longitudinal projection thereof with an integral outwardly extending support plate blocking off said one end, said longitudinal dovetail projection being further provided with a central longitudinal groove therein extending therealong, said groove having a configuration complementary to that of said central ribs formed on said vertical dovetail chutes of said block elements.

8. A toy building block set according to claim 7, wherein said outer peripheral wall of each of said blocks has sixteen side faces, said third side faces being diametrally opposite one another and bounded on each side by one of said first side faces, each of said second side faces being bounded on each side by one of said first side faces.

9. A toy building block set according to claim 7, wherein each said stacking member is provided at each of its ends with a pair of lashing rings formed integrally therewith.

10. A toy building block set according to claim 9, further comprising lashing means for securing a stack of blocks arranged upon a pair of said stacking members, said lashing means being adapted for being selectively passed through said lashing rings of the ends of said stacking members.

11. A toy building block set according to claim 10, wherein said lashing means comprises a lashing cord means and adjustable toggle button means being selectively movable and immovable along said lashing cord means, said toggle button means being insertable in end-wise fashion through said lashing rings of said stacking members, but not being insertable in cross-wise fashion through said lashing rings

* * * * *